US007040292B2

(12) United States Patent
Bruehmann et al.

(10) Patent No.: US 7,040,292 B2
(45) Date of Patent: May 9, 2006

(54) DEVICE FOR DAMPING VIBRATIONS ON FUEL INJECTION SYSTEMS HAVING A HIGH-PRESSURE ACCUMULATING SPACE

(75) Inventors: Werner Bruehmann, Stuttgart (DE); Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 24 days.

(21) Appl. No.: 10/508,552

(22) PCT Filed: Dec. 13, 2002

(86) PCT No.: PCT/DE02/04567

§ 371 (c)(1),
(2), (4) Date: Sep. 22, 2004

(87) PCT Pub. No.: WO03/081021

PCT Pub. Date: Oct. 2, 2003

(65) Prior Publication Data

US 2005/0178363 A1 Aug. 18, 2005

(30) Foreign Application Priority Data

Mar. 22, 2002 (DE) ..... 102 12 876

(51) Int. Cl.
*F02M 37/04* (2006.01)

(52) U.S. Cl. ..... 123/467; 123/456

(58) Field of Classification Search ..... 123/467, 123/456, 468, 469, 447, 470, 514, 198 D
See application file for complete search history.

(56) References Cited

U.S. PATENT DOCUMENTS

| | | | | |
|---|---|---|---|---|
| 4,336,781 | A * | 6/1982 | Overfield | 123/467 |
| 4,577,606 | A * | 3/1986 | Bohringer et al. | 123/506 |
| 4,964,391 | A * | 10/1990 | Hoover | 123/510 |
| 5,511,528 | A * | 4/1996 | Iwanaga et al. | 123/467 |
| 5,752,486 | A * | 5/1998 | Nakashima et al. | 123/467 |
| 5,950,669 | A * | 9/1999 | Fehlmann et al. | 137/493.3 |
| 6,131,607 | A * | 10/2000 | Cooke | 137/508 |
| 6,263,863 | B1 * | 7/2001 | Giovannini et al. | 123/470 |
| 6,435,161 | B1 * | 8/2002 | Kato | 123/468 |
| 6,463,909 | B1 * | 10/2002 | Asada et al. | 123/456 |
| 6,796,775 | B1 * | 9/2004 | Mori | 417/273 |
| 6,830,034 | B1 * | 12/2004 | Engelmeyer et al. | 123/470 |

* cited by examiner

*Primary Examiner*—Carl S Miller
(74) *Attorney, Agent, or Firm*—Ronald E. Greigg

(57) ABSTRACT

The invention relates to a high-pressure accumulator for fuel injection systems, having a number of line connections corresponding to the number of chambers of an internal combustion engine. The accumulator has an essentially circular cross section delimited by an inner wall. The individual line connections each have a fuel-conveying longitudinal bore and, with the aid of a screw element, are held in a fitting fastened to the outside of the high-pressure accumulator. The screw element presses the respective high-pressure line connection into a seat. The high-pressure accumulator has an oscillation-damping valve integrated into it that includes a closing element, which is acted on by a spring body supported against a shaft connected to the closing element and is optionally supported against the inside of the high-pressure accumulator.

15 Claims, 4 Drawing Sheets

11
16
15
10
14
9
12
13
18
17
24
1
20
19
23
28
7
22
3
26
25
27
8
2
6
4
5

DEVICE FOR DAMPING VIBRATIONS ON FUEL INJECTION SYSTEMS HAVING A HIGH-PRESSURE ACCUMULATING SPACE

CROSS-REFERENCE TO RELATED APPLICATIONS

This application is a 35 USC 371 application of PCT/DE 02/04567 filed on Dec. 13, 2002.

BACKGROUND OF THE INVENTION

1. Field of the Invention

Modern injection systems for injecting fuel into the combustion chambers of air-compressing internal combustion engines use high-pressure accumulators (common rails). These high-pressure accumulators, which are usually tubular and constructed with thick walls, have throttle valves located at pressure tube connections. The throttle valves damp the reflected pressure waves that can be generated when the nozzle in the fuel injector closes at the end of the injection process.

2. Prior Art

DE 196 50 865 A1 discloses a solenoid valve for controlling the fuel pressure in the control pressure chamber of an injection valve, for example in the injector of a common rail injection system. The fuel pressure in the control pressure chamber is used to control the movement of a valve piston that opens and closes an injection opening of the injection valve. The solenoid valve has an electromagnet contained in a housing part, a movable armature, and a control valve element; this control valve element is moved by the armature, is acted on in the closing direction by a closing spring, and cooperates with a valve seat of the solenoid valve, thus controlling the flow of fuel out of the control pressure chamber. The relief of pressure in the control chamber causes the nozzle needle inside the injector body to move in the opening direction, whereas an exertion of pressure on the control pressure chamber produces a closing movement of the nozzle needle, which closing motion is the source of the pressure pulsations, i.e. the reflected pressure waves.

DE 197 08 104 A1 also discloses a solenoid valve for controlling the fuel pressure in the control pressure chamber of an injection valve. This valve is likewise used in the injector of a common rail injection system. The solenoid valve has an electromagnet contained in a housing part, a movable armature, and a control valve element that is moved by the armature; this control valve element is acted on in the closing direction by a closing spring, and cooperates with a valve seat of the solenoid valve, thus controlling the flow of fuel out of the control pressure chamber. According to the embodiment disclosed in DE 197 08 104 A1, the armature of the solenoid valve is comprised of two parts, with an armature bolt and an armature plate that is supported so that it can slide smoothly on the armature bolt. The two-part design reduces the effective mass to be decelerated and therefore reduces the chattering behavior of the armature. However, the armature plate that can be moved in relation to the armature bolt can continue to oscillate on the armature bolt in a disadvantageous manner after the closing of the solenoid valve, and can thus trigger the occurrence of pressure pulsations, i.e. reflected pressure waves when the injection valve element closes.

The Bosch Manual "Diesel Motor Management", 2$^{nd}$ updated and expanded edition; Vieweg 1998, Braunschweig/Wiesbaden ISBN 3-528-03873-X, p. 231, right column, describes a return flow throttle valve, which is used to damp pressure waves in fuel injection systems. The return flow throttle valve known from the above-cited literature prevents the pressure waves generated at the end of the injection process and their reflections from causing a reopening of the nozzle needle, i.e. of the injection valve element. An uncontrolled reopening of the nozzle needle and the resulting secondary injection into the combustion chambers of the engine would have very negative repercussions on the emissions in the exhaust of the air-compressing internal combustion engine since the percentage of uncombusted hydrocarbons would rise considerably with the occurrence of uncontrolled secondary injections.

At the onset of fuel delivery, the spring-loaded valve cone of the return flow throttle valve is lifted away from its seat by the fuel pressure. The fuel is then conveyed to the injection nozzle via a pressure tube connection and the pressure tube line. At the end of the fuel delivery, the fuel pressure drops abruptly. The valve spring presses the valve cone back against the valve seat. During the closing of the injection nozzle, a throttle restriction incorporated into the valve cone reduces reflected pressure waves in the fuel injector to such an extent that it prevents damaging pressure wave reflections that would contribute to a premature fatiguing of the material of the high-pressure accumulator.

In the known return flow throttle valve, it is disadvantageous that the return flow throttle elements take up a relatively large amount of space. This has a negative impact on installation possibilities; moreover, there is only a very limited amount of space available in the cylinder head region of internal combustion engines. Furthermore, embodying the return flow throttle as a multi-part component has a negative impact on the number of sealing points.

DESCRIPTION OF THE PREFERRED EMBODIMENTS

The embodiments according to the invention provide an oscillation-damping valve that is integrated into the interior of the high-pressure accumulator (common rail). In addition, when the embodiments proposed according to the invention is used, the existing interfaces of systems currently in use can be retained because the invention does not require them to be modified. The oscillation-damping valve is also pre-assembled and securely contained inside the high-pressure accumulator (common rail). It is also unnecessary to modify or remachine existing line systems, whether they lead toward or away from the high-pressure accumulator, and the invention can therefore be used in a modular system, independent of type. Another advantage of the proposed oscillation-damping valve lies in the fact that it is significantly less expensive to produce than the return flow throttle elements described in the literature cited at the beginning.

In addition to the inner diameter of the high-pressure accumulator (common rail) and the seal in relation to the high-pressure line, the attachment of the line can also remain virtually unchanged. This can be achieved because the closing element of the oscillation-damping valve is accommodated on the interior of the high-pressure accumulator and the external region of the accumulator is therefore unaffected by all of the attachments and system components located there. The closing element of the oscillation-damping valve advantageously acts on the sealing point between the high-pressure accumulator (common rail) and the high-pressure line to the injector and therefore also advantageously acts on the point at which the returning pressure waves or pressure wave reflections—which occur when an injection valve element, e.g. a nozzle needle, closes at the end of the injection—can travel back into the high-pressure accumulator (common rail).

In addition to the embodiment proposed according to the invention designed in the form of individual springs that are each accommodated on a part of a closing element, e.g. a retaining bolt, and supported against the inner wall of the high-pressure accumulator, the closing element can also be comprised of a one-piece spring strip that makes it significantly easier to insert axially from one end into the tubular inner chamber of the high-pressure accumulator. When the closing element is comprised of one piece, with supporting spring tabs provided on it, these spring elements can be bent back, die-cut, or curved by means of a tool.

These one-piece closing/spring elements can—depending on the axial length, the position, and the number of the outlet bores and in particular the spacing between them—be made to be variant-specific at a considerably lower manufacturing cost than the return flow throttle elements known from the prior art.

BRIEF DESCRIPTION OF THE DRAWINGS

The invention will be described in detail below in conjunction with the drawings, in which.

DESCRIPTION OF THE PREFERRED EMBODIMENTS

Figure 1:
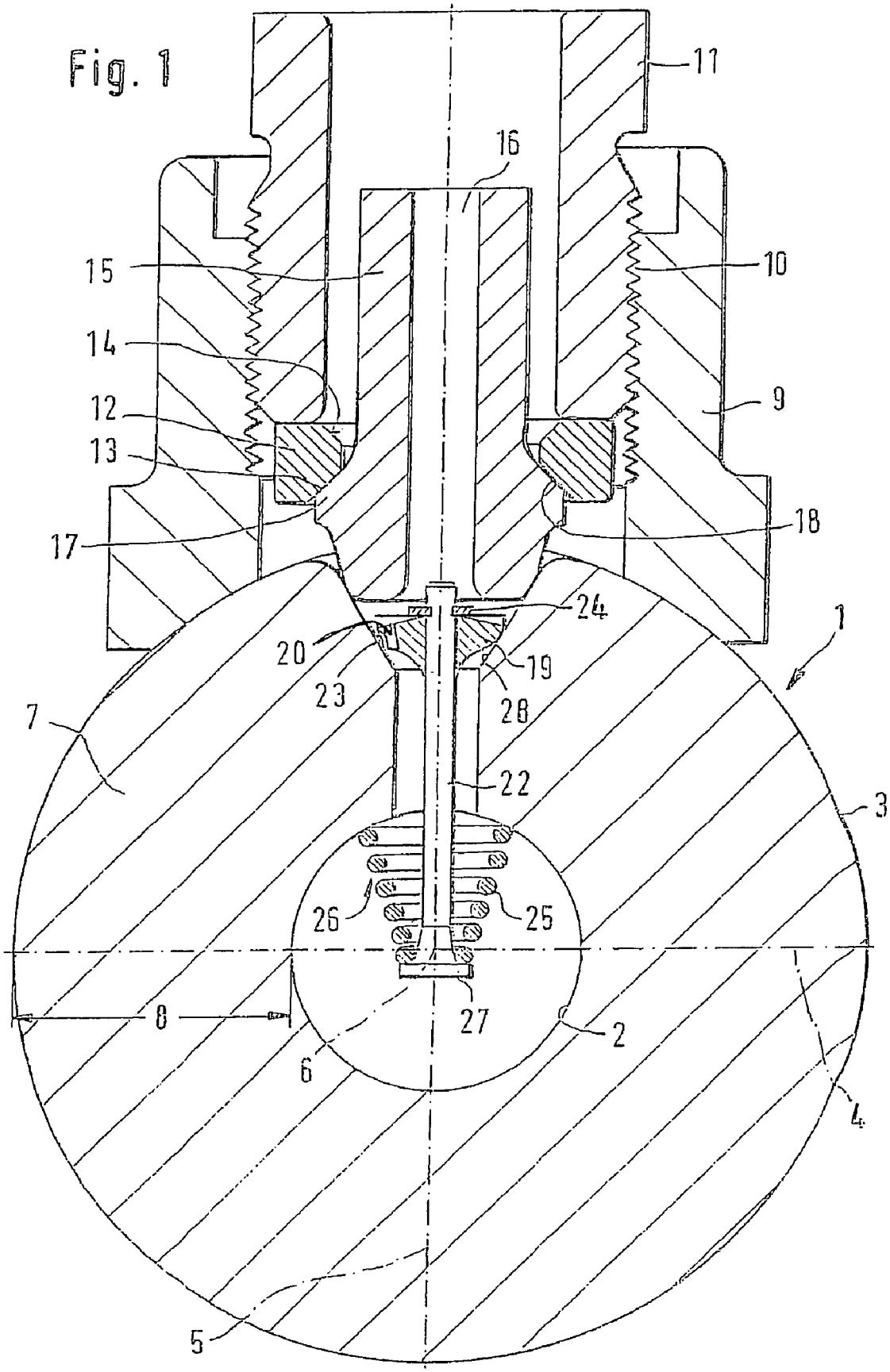
FIG. 1 shows a first embodiment according to the invention, in which a prestressed retaining-bolt spring holds and acts on a closing element.

FIG. 1 shows a first embodiment according to the invention, in which a closing element is accommodated on a retaining-bolt spring in a prestressed fashion. A high-pressure accumulator 1 delimits a tubular, essentially circular cavity by means of an inner wall 2. The outer wall of the high-pressure accumulator 1 is labeled with the reference numeral 3 in the depiction in FIG. 1. The lateral axis 4 of the high-pressure accumulator extends horizontally; the vertical axis 5 of the high-pressure accumulator extends perpendicular to the lateral axis. The longitudinal axis 6 of the high-pressure accumulator 1 passes through the plane of the drawing at the intersecting point of the lateral axis 4 and the vertical axis 5. The wall 7 of the high-pressure accumulator is-embodied with a wall thickness 8; the high-pressure accumulator 1 is essentially tubular and is generally embodied as a forged component. The wall thickness 8 is appropriately designed to withstand the high pressures that occur on the interior of the high-pressure accumulator 1. The outer wall 3 of the high-pressure accumulator 1 has a fitting 9 fastened to it, which fitting includes an internally threaded section 10. A screw connection element 11 with a corresponding externally threaded section is screwed into this fitting and holds in place a high-pressure line, not shown in FIG. 1, which extends to the corresponding injector of a combustion chamber of the internal combustion engine. The high-pressure line, which is held in place by the screw connection 11 and is for supplying fuel to the injector of a combustion chamber of the engine, serves to supply this injector with highly pressurized fuel from the high-pressure accumulator 1 for injection into the combustion chamber of the engine, as dictated by the motion of the injection valve element of the injector. When the injection valve element of the injector closes, attendant pressure waves flow back through the high-pressure line to the screw connection 11 and can thus travel back into the interior of the high-pressure accumulator 1.

The screw connection 11 acts on a disk-shaped component 12 that contains a first cone 13, which is supported against a conical seat 18 provided on a shoulder 17 of a high-pressure line connection member 15. The screw connection 11 is supported against the upper annular end surface of the disk-shaped component 12. With this type of attachment of the high-pressure line connection 15, the adjusting force acting on the shoulder 17 places the line connection so that its bottom end rests in a sealed fashion in a seat 28 in the high-pressure accumulator 1.

In order to prevent pressure waves or pressure wave reflections produced by the closing of the injection valve element of the injector from traveling back into the interior of the high-pressure accumulator 1 via the high-pressure line and the high-pressure line connection 15, and thus exerting impermissibly high stress on the high-pressure accumulator 1, the embodiment proposed according to the invention provides an oscillation-damping valve that essentially includes a closing element 19 and a spring body 25 or 32, 40, which acts on the closing element by means of a shaft 22.

In the exemplary embodiment of the oscillation-damping valve according to the depiction in FIG. 1, an essentially disk-shaped closing element 19 is shown, whose outer contour essentially corresponds to the shape of the seat surface of the seat 28 that is fed by a bore, which passes through the wall 7 of the high-pressure accumulator 1. The closing element 19 includes the rod-shaped shaft 22 whose end protruding into the interior of the high-pressure accumulator 1 is provided with a support 27 for accommodating a spring body 25. In the exemplary embodiment of the oscillation-damping valve according to FIG. 1, the closing element 19 is connected by means of a snap ring 24 to the shaft 22 that serves as a retaining bolt. On the circumference of the closing element 19, i.e. in the seat region 23 of the seat 28, at least one return flow opening 20 is provided, which functions like a throttle and permits a return flow of fuel when pressure waves are reflected toward the high-pressure accumulator 1, and therefore permits a return flow of fuel via the high-pressure line connection 15, through its longitudinal bore 16, into the interior of the high-pressure accumulator 1 without subjecting the accumulator to powerful pressure surges, essentially due to the throttling action of the return flow opening 20.

According to the first embodiment of the oscillation-damping valve proposed according to the invention shown in FIG. 1, the closing element 19 essentially embodied in the form of a disk and the shaft 22 serving as a retaining bolt are two separate components that are connected to each other in captive fashion by means of a circlip or an otherwise embodied fastening element 24. The support 27 provided at the bottom end of the shaft 22 serving as a retaining bolt supports the coil of a spring body 25 which is preferably designed in the form of a spiral spring and has coils that widen out in diameter in accordance with a conical contour 26 as they approach the inner wall 2 of the high-pressure accumulator 1. As a result of its conical contour 26, the spring body 25 rests against the inner wall 2 of the high-pressure accumulator 1 with a greater diameter than it does against the support 27 in the lower region of the shaft 22 serving as a retaining bolt. The conical contour 26 of the spring body 25 also facilitates insertion of the spring body 25 through the bore in the wall 7 of the high-pressure accumulator, which bore extends coaxial to the vertical axis 5 of the high-pressure accumulator 1.

In the variant of the oscillation-damping valve proposed according to the invention shown in FIG. 1, a separate spring element 25 acts on each pairing of an oscillation-damping valve and a high-pressure line connection 15, the valve of which is essentially comprised of a closing element 19, a shaft 22, and a spring body 25 that acts on the closing element 19. This means that along the longitudinal direction 6 of the high-pressure accumulator 1, a number of oscillation-damping valves 19, 22, 25 is provided that corresponds to the number of high-pressure line connections 15, which number in turn corresponds to the number of cylinders of the internal combustion engine to be supplied with fuel; these oscillation-damping valves are all prestressed independently of one another by individual spring bodies 25 that have a conical contour 26 in order to facilitate their insertion into the interior of the high-pressure accumulator 1.

The spring that exerts the closing force of the oscillation-damping valve according to the exemplary embodiment in FIG. 1 is integrated into the interior of the high-pressure accumulator, which permits existing interfaces, such as the inner diameter of the high-pressure accumulator 1, the sealing point in relation to the high-pressure line connection 15, and the attachment of the high-pressure line to the high-pressure line connection 15 to remain unchanged. The closing element 19 according to the embodiment of the oscillation-damping valve proposed according to the invention acts directly on the sealing point 23, 28 underneath the high-pressure line connection 15. The attachment of the closing element 19 to the shaft 22 serving as a retaining bolt can therefore be produced not only by means of a fastening element 24 embodied in the form of a snap ring or a circlip, but also by means of welding, shrinking, crimping, and other similar connecting techniques. During installation, the shaft 22 and the spring body 25 provided with a conical contour 26 are inserted from the outside through the bore that extends coaxial to the vertical axis 5.

Figure 2:
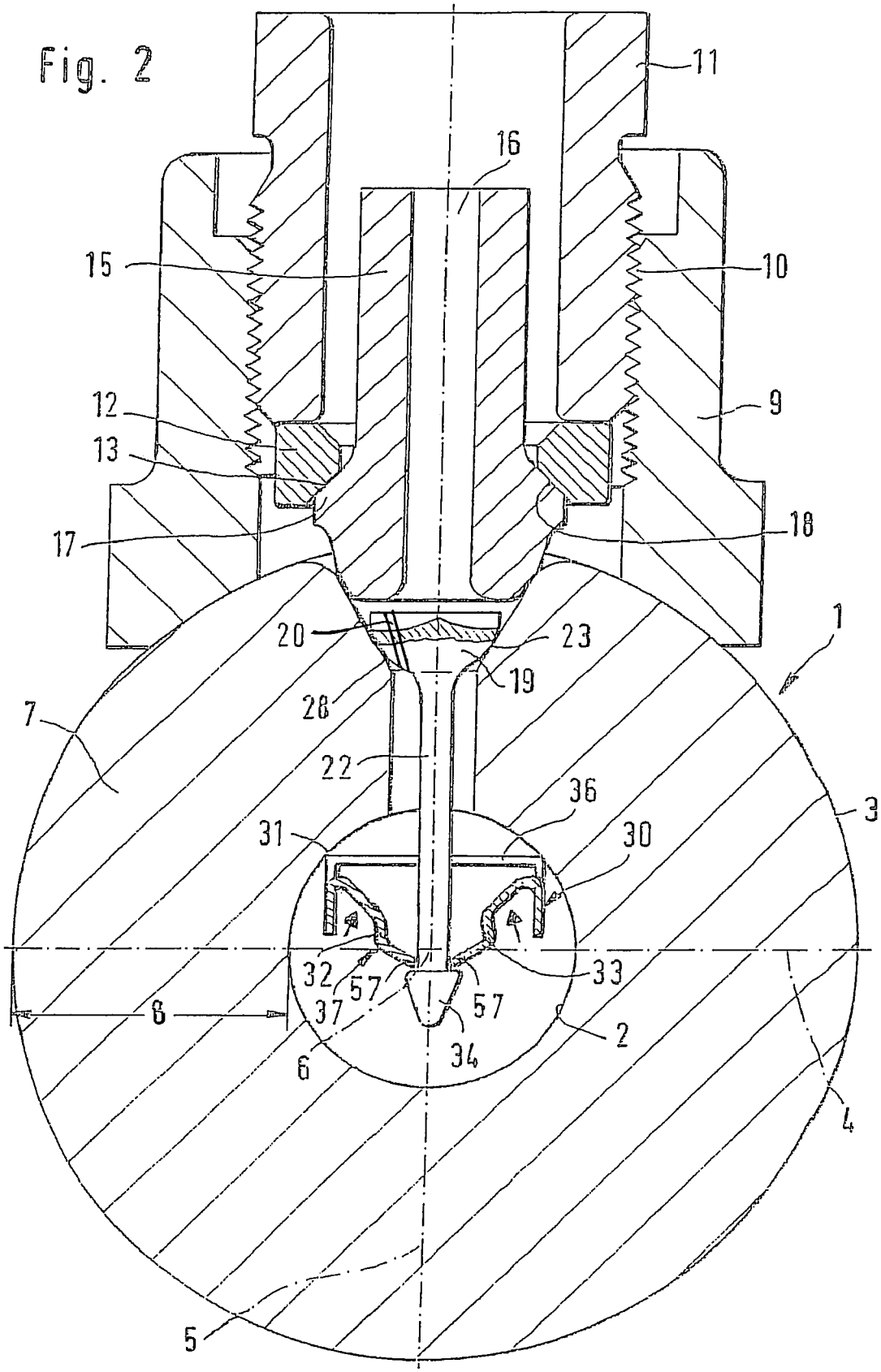
FIG. 2 shows another embodiment proposed according to the invention, with an alternative spring geometry in which the closing element and the spring that acts on it can be comprised of one piece.

FIG. 2 shows another exemplary embodiment of the oscillation-damping valve proposed according to the invention, with an alternative spring body geometry in which the spring element is comprised of one piece.

Details concerning the embodiment of the fitting 9 for connecting the high-pressure line by means of the screw connection 11 and for fastening the high-pressure line connection 15 to the outer wall 3 of the high-pressure accumulator 1 are shown in FIG. 1.

According to the exemplary embodiment of the oscillation-damping valve proposed according to the invention shown in FIG. 2, the closing element 19 and the shaft 22 serving as a retaining bolt are comprised of one piece. At the lower end of the shaft 22 protruding into the interior of the high-pressure accumulator 1, a thickened part 34 is provided, which serves as a support for a pair of spring tabs 32, 33. The spring body 30 comprised of one piece according to the embodiment of the oscillation-damping valve in FIG. 2 is designed as a U-shaped profile that opens toward the interior of the high-pressure accumulator. From a manufacturing standpoint, it is particularly easy to die-cut or bend out the spring tabs 32 and 33 from the one-piece spring body 30 so that they extend on both sides of the shaft 22 of the oscillation-damping valve that protrudes into the interior of the high-pressure accumulator 1. The spring tab ends 57 of the first spring tab 32 and the second spring tab 33 rest against a thickened part of the extension 34 in the lower region of the shaft 22. The first spring tab 32 and the second spring tab 33 can be provided with an S-shaped profile 37 in order to improve the spring action. The support of the first spring tab and the second spring tab 33 against the support 34 causes the one-piece spring body 30 to act on a seating 31 disposed in the upper region of the inner wall 2 of the high-pressure accumulator 1. The one-piece spring body 30 is therefore supported so that it can be moved in relation to the shaft 22 of the oscillation-damping valve according to the embodiment variant shown in FIG. 2. The reference numeral 36 indicates the break-away locations at which the spring tabs 32, 33 are bent out toward the open side of the spring body embodied as a U-shaped profile.

The closing element 19 of the oscillation-damping valve according to the embodiment variant shown in FIG. 2 can also be provided with a lateral return flow opening 20 on the circumference, analogous to the embodiment of the closing element 19 according to the variant shown in FIG. 1. In the embodiment variant shown in FIG. 2, all of the spring elements are connected to one another in the longitudinal direction 6 of the high-pressure accumulator 1. During installation, the one-piece spring body 30 is inserted in the axial direction, i.e. in the direction of the longitudinal axis 6, into the interior of the high-pressure accumulator 1. This simplifies the installation considerably; the one-piece spring body 30 can be embodied with an axial length specifically matched to the length of the high-pressure accumulator 1, which permits type-specific, one-piece spring elements 30 to be provided, whose design corresponds to the number of cylinders of the engine to be supplied with fuel by the high-pressure accumulator 1 and to the spacing distance of the high-pressure connections 15 in the longitudinal direction of the high-pressure accumulator 1. During installation into the interior of the high-pressure accumulator 1, the one-piece spring body 30 is inserted in the longitudinal direction, into the interior of the high-pressure accumulator; the spring tabs 32, 33, which have an S-shaped curve 37, can be pressed back by means of an auxiliary tool and locked against their respective shafts 22, which protrude into the interior of the high-pressure accumulator 1, spaced apart from one another at distances that correspond to the distances between the high-pressure line connections 15.

Depending on the manufacturing process, i.e. how the individual spring tabs 32 and 33 are bent out from the locations 36, the spring tabs 32, 33 can also be provided with a contour 37 embodied other than in an S-shape in order to assure a placement of the edges that produce the seating 31 against the inner wall 2 of the high-pressure accumulator. It is essential that the spring tab ends 57 of opposing spring tabs 32, 33 be supported against the support 34 at the lower end of the shaft 22 passing through the axial bore of the high-pressure accumulator, and consequently both pull the closing element 19 into the seat 28 and place the spring body 30—which in this exemplary embodiment of the oscillation-damping valve proposed according to the invention is comprised of one piece tightly into its seating 31 situated in the upper region of the high-pressure accumulator.

Figure 3:
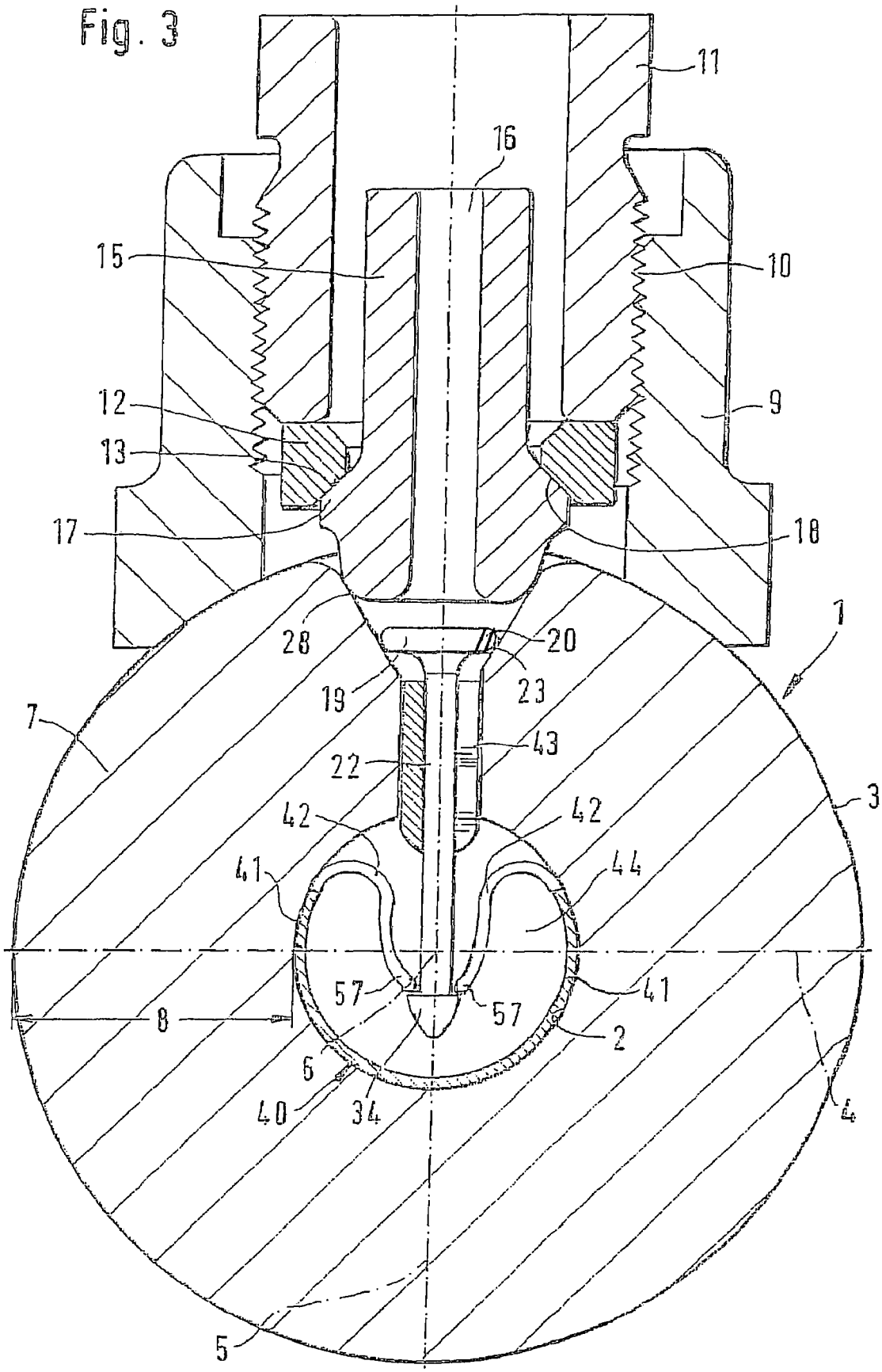
FIG. 3 shows a third embodiment that can be installed in the axial direction into the interior of the high-pressure accumulator (common rail)

FIG. 3 shows another exemplary embodiment of the oscillation-damping valve proposed according to the invention, which can be installed in the axial direction in the high-pressure accumulator (common rail). According to this third exemplary embodiment of the oscillation-damping valve proposed according to the invention, analogous to the exemplary embodiments in FIG. 1 and FIG. 2, a closing element 19 is disposed above a bore in the wall 7 of the high-pressure accumulator 1; a shaft 22 serving as a retaining bolt extends from this closing element into the interior of the high-pressure accumulator 1. By contrast with the exemplary embodiments in FIG. 1 and FIG. 2, the shaft 22 is encompassed by a guide 43, which can be embodied as protruding partially into the interior of the high-pressure accumulator 1, i.e. past its inner wall 2. The closing element 19 of the exemplary embodiment of the oscillation-damping valve in FIG. 3 can be provided on its outer circumference with at least one return flow opening 20 that functions as a throttle. The bottom end of the shaft 22, which protrudes into the interior of the high-pressure accumulator 1, has a support 34 similar to the ones shown in FIGS. 1 and 2, which supports a one-piece spring body 40 that is annular in this exemplary embodiment. The one-piece annular spring body 40 extends in the form of a ring along the wall 2 of the high-pressure accumulator 1 and in the vicinity of each high-pressure connection 15, has spring arms 42 that are scored in the direction of the longitudinal axis 6 of the high-pressure accumulator 1 and whose ends 57 rest against the top of the support 34 at the bottom end of the shaft 22. The scored spring arms 42 transition into an annular section 41, whose circumference surface is designed so as to correspond to the contour of the inner wall 2 of the high-pressure accumulator 1. The annular one-piece spring body 40 is embodied as oversprung. This means that after an insertion of the spring body 40 in the longitudinal direction 6 of the high-pressure accumulator, the scored spring arms 42 can be bent in the direction of the two arrows shown in FIG. 3 so that the spring body, i.e. the ends 57 of the scored spring arms 42 can lock into place above the support 34 at the bottom end of the shaft 22. The guide 43 encompassing the shaft 22 facilitates the installation; the guide 43 can be provided in the form of three or more guide ribs disposed on the shaft 22 offset from one another by 120° or by 90°, depending on the number of ribs, in order to facilitate the installation of the annular one-piece spring body 40. This configuration of the one-piece spring body 40 allows the closing process to be simplified since the closing element travels more easily and rapidly into the seat provided and also assures the production of a reliable seal.

The closing element 19, the shaft 22, and the annular spring body 40 that essentially comprise the oscillation-damping valve achieve a reduction in the returning pressure pulsations or pressure wave reflections traveling back into the high-pressure accumulator 1 via the high-pressure connection 15 and via its longitudinal bore 16. These pressure pulsations or pressure waves are generated at the end of the injection phase when the injection valve of an injector supplied via the high-pressure accumulator moves into its seat, i.e. when the injection is terminated. Since an internal combustion engine equipped with a common rail fuel injection system includes 4, 6, or 8 cylinders, upon termination of their injections, the 4, 6, or 8 fuel injectors can cause pressure waves or pressure wave reflections to travel back to the high-pressure connections 15 of the high-pressure accumulator 1 via the respective high-pressure lines, which can result in a pressure surge in the interior of the high-pressure accumulator 1 (common rail). The oscillation-damping valve proposed according to the invention in the exemplary embodiment schematically depicted in FIG. 1, 2, or 3 can reduce the mechanical effects of pressure surges traveling back into the high-pressure accumulator through the return flow openings 20 in the upper region of the closing element 19 since the at least one return flow opening 20 provided on the outer contour in relation to the seat 23, 28 functions as a throttle.

Figure 4:
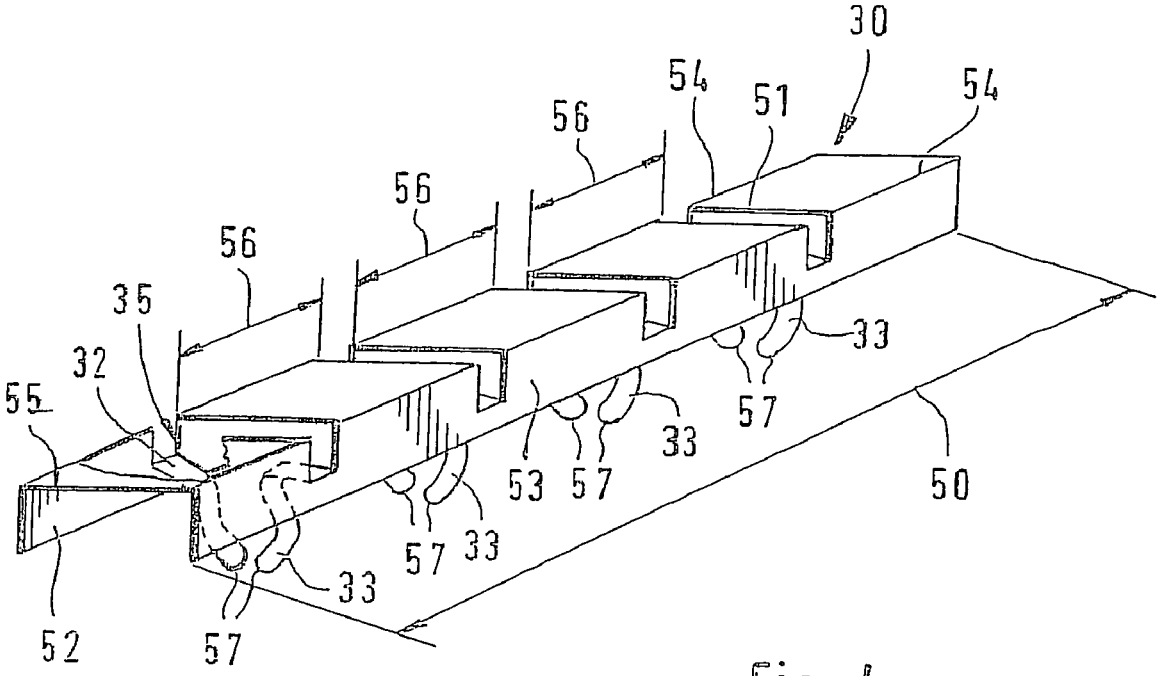
FIG. 4 shows the perspective view of a one-piece closing element for integration into a tubular cavity of the high-pressure accumulator, with die-cut spring tabs on the closing element.

FIG. 4 shows a perspective view of a one-piece closing element, which has die-cut spring tabs and is designed to be integrated into the high-pressure accumulator embodied with an essentially tubular cross section. The one-piece spring body 30 extends over an axial length 50, which corresponds to the length of the high-pressure accumulator 1 into which the one-piece spring body 30 is slid in the axial direction that corresponds to its longitudinal axis 6. Spaced apart at intervals 56, spring tabs 32 and 33 are die-cut in a downward direction from the one-piece spring body 30. These spring tabs rest with their ends 57 against the top of the support 34 (see FIG. 2) and consequently press the sealing edges 54—which are formed at the angled corners of the one-piece spring element embodied as a U-shaped profile—55 against the inner wall 2 of the high-pressure accumulator 1.

The side surfaces of the one-piece spring body 30 embodied as a U-shaped profile 55 are labeled with the reference numerals 52 and 53 and are shorter than the bridge piece that connects the two side surfaces 52 and 53 to each other. The spring tabs 32 and 33—which can extend with an S-shaped contour 37 or can have a contour that allows them to act with a different spring action—rest with their spring tab ends 57 against the support 34 and consequently produce a seating at the top end of the high-pressure accumulator 1 underneath each high-pressure line connection 15. Depending on the number of injectors and the position of their high-pressure lines 15, the one-piece spring body 30 can be embodied in a type-specific length 50, in which the distance 56 between and number of die-cutting locations 51 for the downward-extending spring tabs 32 and 33 are a function of the number of oscillation-damping valves, i.e. the number of high-pressure line connections 15 that are provided at the upper end of the wall 7 of the high-pressure accumulator 1 in the exemplary embodiments of the oscillation-damping valve shown in FIGS. 1, 2, and 3.

The foregoing relates to preferred exemplary embodiments of the invention, it being understood that other variants and embodiments thereof are possible within the spirit and scope of the invention, the latter being defined by the appended claims.

The invention claimed is:

1. A high-pressure accumulator (1) for fuel injection systems, comprising a number of high-pressure line connections (15) and a number of connecting fittings (9) on its outer surface corresponding to the number of combustion chambers of an internal combustion engine to be supplied with fuel, the accumulator (1) having an essentially circular cross section that is delimited by an inner wall (2);

the high-pressure line connections (15) each having a fuel-conveying longitudinal bore (16) and, with the aid of a screw connection element (11), are held in a fitting (9) fastened to the outside of the high-pressure accumulator (1), the connecting fittings (9) pressing the respective high-pressure line connection (15) into a seat (28) in the high-pressure accumulator (1), and an oscillation-damping valve with a closing element (19) that is acted on by a spring body (25; 30, 32, 33; 40) contained in the accumulator (1), the oscillation-damping valve being supported against a shaft (22) connected to the closing element (19) and against the inner wall (2).

2. The high-pressure accumulator (1) according to claim 1, wherein the closing element (19) is accommodated in a bore that passes through the wall (7) of the high-pressure accumulator (1) and ends at the seat (28), which accommodates the high-pressure line connection (15).

3. The high-pressure accumulator (1) according to claim 1, wherein the seat (28) is embodied as a conical seat (23) in order to accommodate the high-pressure line connection (15).

4. The high-pressure accumulator (1) according to claim 1, wherein the closing element (19) comprises a rod-shaped shaft (22) that extends into the interior of the high-pressure accumulator (1) and is provided with a support (27, 34) for a spring body (25; 30, 32, 33; 40).

5. The high-pressure accumulator (1) according to claim 1, further comprising at least one return flow opening (20) that functions as a throttle on the closing element (19), the throttle opening permitting a return flow of fuel from the high-pressure line connection (15) into the high-pressure accumulator.

6. The high-pressure accumulator (1) according to claim 1, wherein the closing element (19) has a disk-shaped outer contour corresponds to the curve of the contour of the seat (28).

7. The high-pressure accumulator (1) according to claim 1, wherein the oscillation-damping valve closing elements (19) associated with the individual high-pressure line connections (15) are prestressed by means of individual spring bodies (25).

8. The high-pressure accumulator (1) according to claim 7, wherein the spring bodies (25) have a conical diameter (26) that widens out as it extends from a support (27) to the inner wall (2).

9. The high-pressure accumulator (1) according to claim 1, wherein the oscillation-damping valve closing elements (19) associated with the individual high-pressure line connections (15) are all prestressed by means of a single one-piece spring body (32, 40).

10. The high-pressure accumulator (1) according to claim 9, wherein the one-piece spring body (30) comprises a U-shaped profile (55) having spring tabs (32, 33) extending from its surfaces, and the ends (57) of the spring tabs rest against a support (34) of the shaft (22).

11. The high-pressure accumulator (1) according to claim 10, wherein sealing edges (54) are embodied on the U-shaped profile (55) of the one-piece spring body (30) and rest against the inner wall (2) of the high-pressure accumulator (1).

12. The high-pressure accumulator (1) according to claim 9, wherein the spring tabs (32, 33) are disposed opposite each other in pairs that are spaced apart from one another at intervals (56) on the one-piece spring body (30).

13. The high-pressure accumulator (1) according to claim 9, wherein the length (50) of the one-piece spring body (30) corresponds to the span of the high-pressure accumulator (1) in the longitudinal direction (6).

14. The high-pressure accumulator (1) according to claim 9, wherein the one-piece spring body (40) comprises as an oversprung spring body whose outer contour (41) corresponds to that of the inner wall (2) having scored spring arms (42) whose ends (57) rest against the support (34) of the shaft (22).

15. The high-pressure accumulator (1) according to claim 1, further comprising a guide (43) extending through the bore for the high-pressure line connection (15) and guiding the shaft (22) of the closing element (19) in the bore.

* * * * *